US011022077B2

(12) United States Patent
Tan et al.

(10) Patent No.: US 11,022,077 B2
(45) Date of Patent: Jun. 1, 2021

(54) EGR COOLER WITH INCONEL DIFFUSER

(71) Applicant: Caterpillar Inc., Peoria, IL (US)

(72) Inventors: Dongming Tan, Dunlap, IL (US); Michael Pollard, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/539,560

(22) Filed: Aug. 13, 2019

(65) Prior Publication Data

US 2021/0047989 A1 Feb. 18, 2021

(51) Int. Cl.

| | |
|---|---|
| ***F02M 26/22*** | (2016.01) |
| ***F02M 26/32*** | (2016.01) |
| ***F02M 26/29*** | (2016.01) |
| ***F02M 26/28*** | (2016.01) |

(52) U.S. Cl.

CPC ..... *F02M 26/22* (2016.02); *F02M 26/28* (2016.02); *F02M 26/29* (2016.02); *F02M 26/32* (2016.02)

(58) Field of Classification Search

CPC ..... F02M 26/22; F02M 26/28; F02M 26/29; F02M 26/32

USPC ..... 123/568.12

See application file for complete search history.

(56) References Cited

U.S. PATENT DOCUMENTS

| | | | | |
|---|---|---|---|---|
| 5,915,472 | A * | 6/1999 | Takikawa | F28D 7/1607 165/158 |
| 6,257,483 | B1 | 7/2001 | Inaba | |
| 6,543,675 | B1 * | 4/2003 | Laudic | B23K 1/0012 228/183 |
| 7,886,810 | B2 | 2/2011 | Angermann | |
| 8,720,199 | B2 * | 5/2014 | Gaensler | F02M 26/32 60/599 |
| 2001/0047861 | A1 | 12/2001 | Maeda et al. | |
| 2003/0010480 | A1 * | 1/2003 | Shibagaki | F28D 9/0031 165/158 |
| 2006/0107933 | A1 * | 5/2006 | Dilley | F02M 26/36 123/568.12 |
| 2011/0176953 | A1 | 7/2011 | Hiraide et al. | |
| 2015/0068503 | A1 * | 3/2015 | Wu | F02M 26/70 123/568.21 |
| 2017/0138670 | A1 * | 5/2017 | Penny | F28F 1/426 |
| 2018/0021894 | A1 | 1/2018 | Persson et al. | |

FOREIGN PATENT DOCUMENTS

| | | |
|---|---|---|
| GB | 2251628 A | 7/1992 |

* cited by examiner

*Primary Examiner* — Erick R Solis
(74) *Attorney, Agent, or Firm* — Hibshman Claim Construction PLLC

(57) ABSTRACT

An EGR cooler includes an elongated, stainless steel cooler housing with a first end having a stainless steel end plate and a second end opposite the first end, and an Inconel diffuser having an inlet end defining a gas inlet and an outlet end welded to the stainless steel end plate. The stainless steel end plate having a first thickness and the outlet end of the Inconel diffuser including a sidewall having a second thickness that is 50% or less of the first thickness.

15 Claims, 3 Drawing Sheets

EGR COOLER WITH INCONEL DIFFUSER

TECHNICAL FIELD

This disclosure relates to an exhaust gas recirculation (EGR) cooler, and in particular, to an exhaust gas recirculation (EGR) cooler having an Inconel diffuser.

BACKGROUND

In internal combustion engines, such as gasoline and diesel fueled engines, exhaust gas recirculation (EGR) is often used to reduce nitrogen oxide (NOx) emissions. EGR works by recirculating a portion of the engine's exhaust gas back to the engine cylinders. EGR systems often include a heat exchanger, commonly referred to as an EGR cooler, to lower the temperature of the exhaust gas being recirculated to the intake of the internal combustion engine.

Lowering the temperature of the recirculated exhaust gas results in lower combustion temperatures, which is a key variable for reducing of NOx formation. EGR coolers are primarily stainless steel, since in the environment where the EGR cooler is located is corrosive and other metals would rust, and rust flakes can result in major damage to the engine. EGR coolers, however, are also subject to significant thermal loading and cycling, which results in high thermal stresses on the EGR coolers and the joints attaching the EGR cooler within the EGR system. Thus, EGR coolers and the joints must resist corrosion and withstand the high thermal loads experienced during operation.

For example, U.S. Patent Publication 2001/0047861, entitled "Brazing Method, Brazement, Method of Production of Corrosion-Resistant Heat Exchanger, and Corrosion-Resistant Heat Exchanger," discloses a method of producing a corrosion-resistant heat exchanger made of stainless steel. The method includes plating chrome on a first stainless steel plate to form a chrome-based brazing filler metal layer. Then, plating nickel-phosphorus on the chrome-based brazing filler metal layer to form a nickel-based brazing filler metal layer on the chrome-based brazing filler metal layer. Then heating to a temperature of at least the melting point of the nickel-based brazing filler metal layer to braze the first stainless steel plate to a second stainless steel plate with the chrome-based brazing filler metal layer and the nickel-based brazing filler metal layer interposed between the two plates. Due to this, a high corrosion resistance brazing filler metal containing an Ni—Cr28-P8-etc. alloy composition is obtained between the first and second stainless steel plates.

SUMMARY

In accordance with the present disclosure there is provided a EGR cooler having a stainless steel housing and an Inconel diffuser.

In accordance with one aspect of the present disclosure, an EGR cooler includes an elongated, stainless steel cooler housing with a first end having a stainless steel end plate and a second end opposite the first end, and an Inconel diffuser having an inlet end defining a gas inlet and an outlet end welded to the stainless steel end plate. The stainless steel end plate having a first thickness and the outlet end of the Inconel diffuser including a sidewall having a second thickness that is 50% or less of the first thickness.

In accordance with another aspect of the present disclosure, an engine system, includes an internal combustion engine, having an intake manifold for directing intake air into one or more engine cylinders and an exhaust manifold for routing exhaust from the one or more engine cylinders and an exhaust system configured to receive exhaust from the exhaust manifold. The exhaust system includes an EGR conduit arranged to direct a portion of the exhaust received from the exhaust manifold into the intake manifold and an EGR cooler arranged in the EGR conduit for cooling the portion of the exhaust directed into the intake manifold. The EGR cooler includes an elongated, stainless steel cooler housing with a first end having a stainless steel end plate and a second end opposite the first end, and an Inconel diffuser having an inlet end defining a gas inlet and an outlet end welded to the stainless steel end plate. The stainless steel end plate having a first thickness and the outlet end of the Inconel diffuser including a sidewall having a second thickness that is 50% or less of the first thickness.

In accordance with another aspect of the present disclosure, a method of cooling an exhaust stream being routing via an exhaust conduit from an exhaust manifold on an engine to an intake manifold on the engine, includes directing coolant through a housing of a stainless steel heat exchanger, directing the exhaust stream through an Inconel diffuser welded to a stainless steel end plate at a gas inlet end of the housing, and directing the exhaust stream through a plurality of tubes extending through the housing from the gas inlet to a gas outlet.

BRIEF DESCRIPTION OF THE DRAWINGS

Further features and advantages will be evident from the following illustrative embodiment which will now be described, purely by way of example and without limitation to the scope of the claims, and with reference to the accompanying drawings, in which:

DETAILED DESCRIPTION

Figure 1:
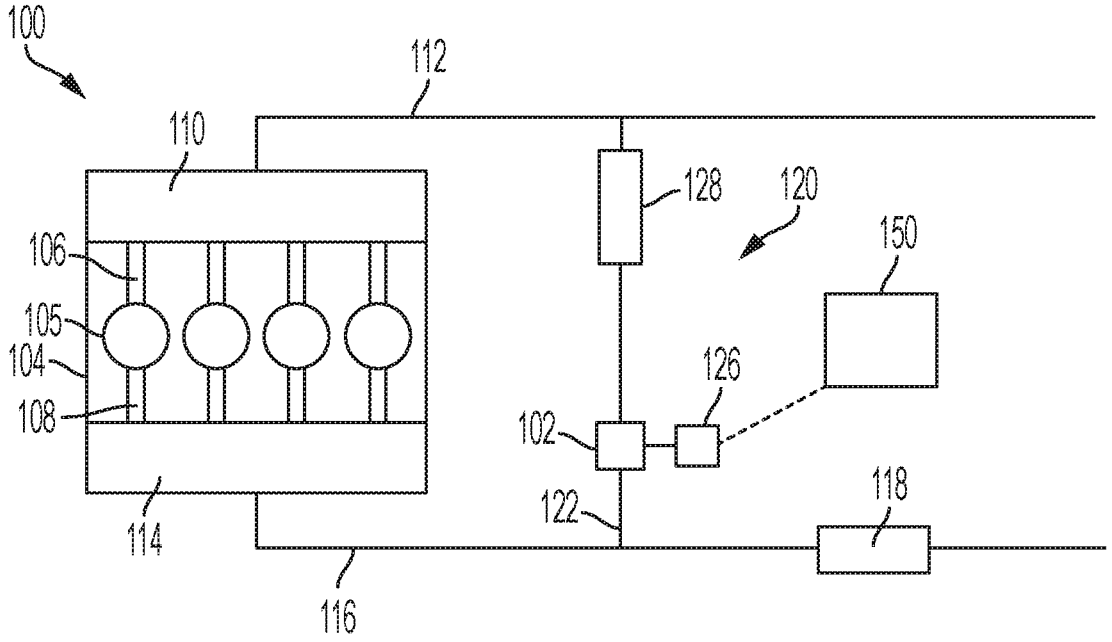
FIG. 1 is a schematic illustration of an exemplary engine system having an exhaust gas recirculation (EGR) valve.

While the present disclosure describes certain embodiments of an EGR cooler having an Inconel diffuser, the present disclosure is to be considered exemplary and is not intended to be limited to the disclosed embodiments. Also, certain elements or features of embodiments disclosed herein are not limited to a particular embodiment, but instead apply to all embodiments of the present disclosure.

As used in this application, "Inconel," which is a trademark of Special Metals Corporation, refers to the known family of austenitic nickel-chromium-based superalloys that use that tradename. As used in this application, "Inconel 625" refers to an austenitic nickel-chromium-based superalloy having the nominal composition ranges shown in Table 1, below:

TABLE 1

| | Cr | Mo | Co | Nb + Ta | Al | Ti | C | Fe | Mn | Si | P | S | Ni |
|---|---|---|---|---|---|---|---|---|---|---|---|---|---|
| Min, % | 20 | 8 | — | 3.15 | — | — | — | — | — | — | — | — | 58.0 |
| Max, % | 23 | 10 | 1 | 4.15 | 0.4 | 0.4 | 0.1 | 5 | 0.5 | 0.5 | 0.015 | 0.015 | Balance |

Additional common trade names for the superalloy Inconel 625, include: Chronin 625, Altemp 625, Haynes 625, Nickelvac 625, and Nicrofer 6020. All of which are considered the same material for purposes of this specification.

The terminology as set forth herein is for description of the embodiments only and should not be construed as limiting the disclosure as a whole. All references to singular characteristics or limitations of the present disclosure shall include the corresponding plural characteristic or limitation, and vice versa, unless otherwise specified or clearly implied to the contrary by the context in which the reference is made. Unless otherwise specified, "a," "an," "the," and "at least one" are used interchangeably. Furthermore, as used in the description and the appended claims, the singular forms "a," "an," and "the" are inclusive of their plural forms, unless the context clearly indicates otherwise.

To the extent that the term "includes" or "including" is used in the description or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. Furthermore, when the phrase "one or more of A and B" is employed it is intended to mean "only A, only B, or both A and B."

The EGR cooler of the present disclosure can comprise, consist of, or consist essentially of the essential elements of the disclosure as described herein, as well as any additional or optional element or feature described herein or which is otherwise useful in welding applications.

Unless otherwise indicated, all numbers expressing parameters, such as amperage, voltage, rate, or other parameters as used in the specification and claims are to be understood as being modified in all instances by the term "about." Accordingly, unless otherwise indicated, the numerical properties set forth in the specification and claims are approximations that may vary depending on the suitable properties sought to be obtained in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements. In general, the term "about" modifies a numerical value above and below the stated value by 10%.

All ranges and parameters, including but not limited to dimensions, percentages and ratios, disclosed herein are understood to encompass any and all sub-ranges assumed and subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, and 10) contained within the range.

Referring to the drawings, FIG. 1 is a schematic illustration of an exemplary engine system 100 having an exhaust gas recirculation (EGR) control valve 102 and an EGR cooler 128. The engine system 100 includes an internal combustion engine 104, such as a diesel engine. The engine 104 may provide power to various types of applications and/or to machines. For example, the engine 104 may power a machine such as an off-highway truck, a railway locomotive, an earth-moving machine, such as a wheel loader, excavator, dump truck, backhoe, motor grader, material handler, or the like. The term "machine" can also refer to stationary equipment like a generator that is driven by an internal combustion engine to generate electricity.

The engine 104 includes one or more cylinders 105 implemented therein. In the illustrated embodiment, the engine 104 includes four cylinders 105. In other embodiments, however, the engine 104 may include more or less than four cylinders 105. The engine 104 may be of an in-line type, a V-type, a rotary type, or other types known in the art. Each of the cylinders 105 may be configured to slidably receive a piston (not shown) therein.

Each of the cylinders 105 includes one or more intake ports 106, each having an intake valve (not shown) and one or more exhaust ports 108, each having an exhaust valve (not shown). The intake valves and the exhaust valves are configured to regulate fluid communication into and out of the cylinders 105 via the one or more intake ports 106 and the one or more exhaust ports 108, respectively. The engine 104 includes an intake manifold 110 in fluid communication with an intake line 112 and an exhaust manifold 114 in fluid communication with an exhaust line 116. Intake air enters the one or more intake ports 106 from the intake line 112 via the intake manifold 110 and exhaust enters the exhaust line 116 from the one or more exhaust ports 108 via the exhaust manifold 114.

The engine system 100 may also include one or more exhaust aftertreatment devices 118, disposed in the exhaust line 116, for trapping exhaust constituents, converting an exhaust constituent from one composition to another composition, or both. The one or more exhaust aftertreatment devices may include a particulate filter, a nitrogen oxides (NOx) conversion module, an oxidation catalyst, combinations thereof, or any other exhaust aftertreatment device known in the art.

The engine system 100 includes an exhaust gas recirculation (EGR) system 120 configured to recirculate a regulated amount of the exhaust received from the cylinders 105 to the intake manifold 110. The EGR system 120 may include an EGR conduit 122 in fluid communication with the exhaust manifold 114 and in fluid communication with the intake manifold 110.

The EGR system 120 includes an EGR control valve 102 disposed in the EGR conduit 122 and configured to meter the amount of the exhaust that is recirculated to the intake manifold 110 via the EGR conduit 122. The EGR control valve 102 may selectively effect, throttle, or block a flow of exhaust gas from the exhaust manifold 114 to the intake manifold 110 via the EGR conduit 122. For example, a position of the EGR control valve 102, such as a valve angle, may be regulated to control the amount of exhaust being passed via the EGR conduit 122. The engine system 100 may include an EGR actuator 126 operatively coupled to the EGR control valve 102. The EGR actuator 126 may be configured to move the position of the EGR control valve 102 thereby controlling the amount of EGR. The EGR actuator 126 may be integral with the EGR control valve 102 or a separate component that is operatively coupled to the EGR control valve 102.

The EGR cooler 128 of the engine system 100 is disposed in the EGR conduit 122. The EGR cooler 128 is provided to reduce a temperature of the exhaust gas passing through the EGR conduit 122. The EGR cooler 128 may be positioned upstream or downstream of the EGR control valve 102. In some embodiments, the EGR system 120 may optionally include a bypass (not shown) around the EGR cooler 128. It may further be contemplated to provide additional components (not shown), such as one or more turbochargers, inter-coolers, aftercoolers, filters and the like, in the engine system 100. These components of the engine 104 are well known in the art and therefore a detailed description is not included herein.

The engine system 100 also includes a controller 150 configured to regulate the amount of EGR by controlling the EGR control valve 102. The controller 150 may be configured in a variety of ways. The controller 150 may embody a single microprocessor or multiple microprocessors configured for receiving signals from the various components of the engine system 100. It should be appreciated that the controller 150 may embody a machine microprocessor capable of controlling numerous machine functions. A person of ordinary skill in the art will appreciate that the controller 150 may additionally include other components and may also perform other functions not described herein. The controller 150 may also be configured to receive inputs from an operator via a user interface (not shown). In one exemplary embodiment, the controller 150 is an engine control module (ECM) of the engine 104.

Figure 2:
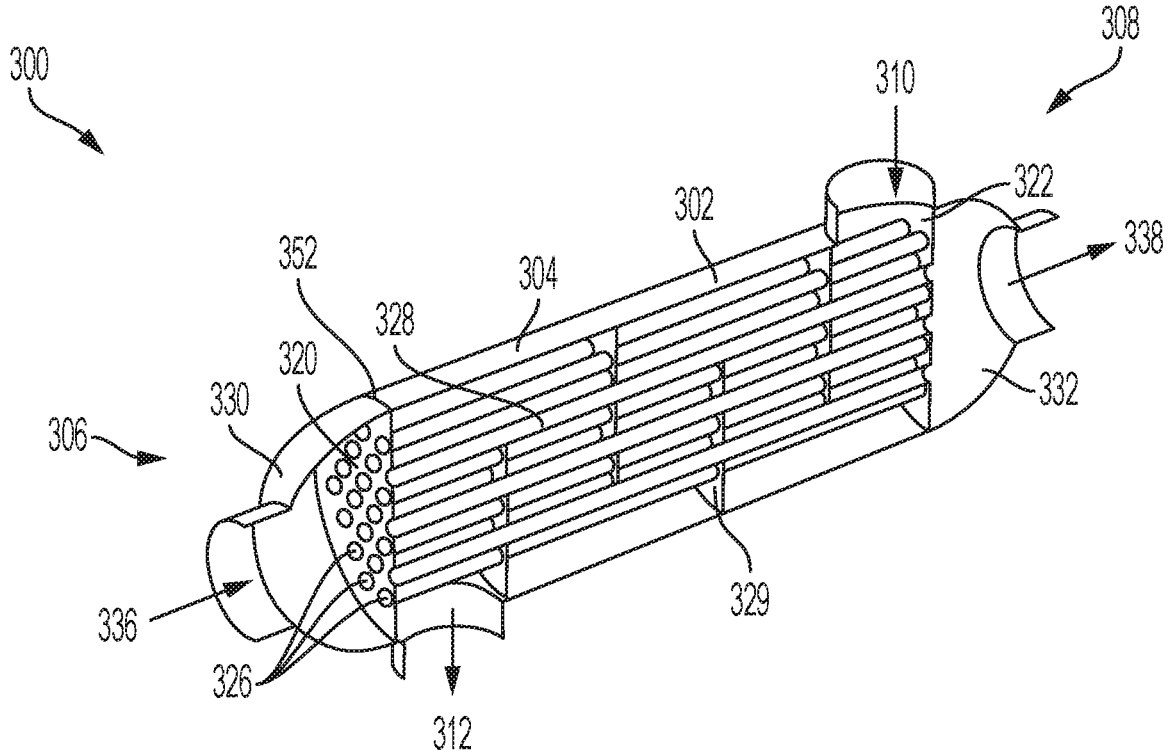
FIG. 2 is a side view of an exemplary embodiment of an EGR cooler.
Figure 3:
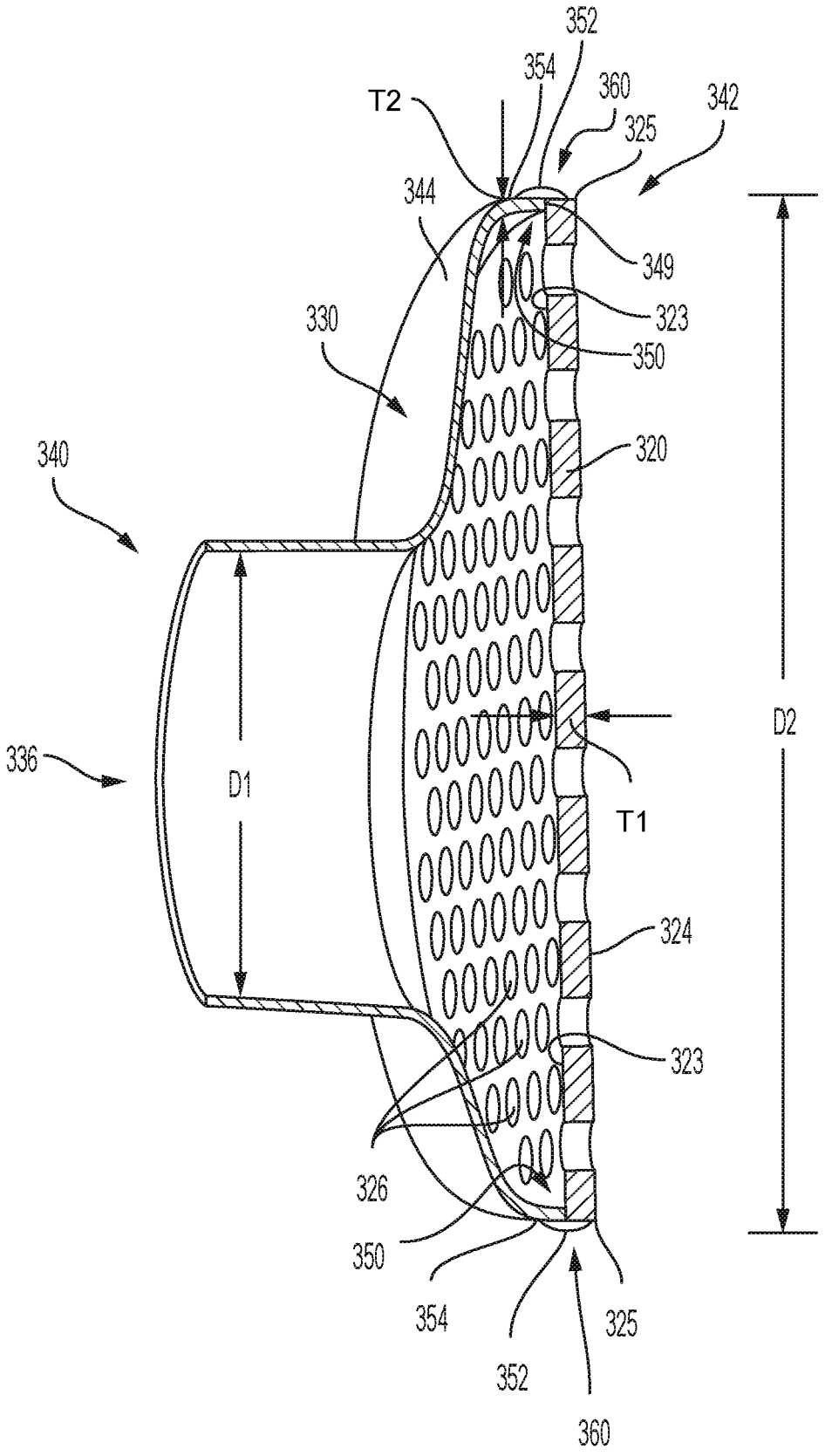
FIG. 3 is a partial sectional exploded view of the header and diffuser of the EGR cooler of FIG. 2.

FIGS. 2-3 illustrate an exemplary EGR cooler 300. The EGR cooler 300 is illustrated as a shell and tube heat exchanger, but other types of heat exchangers, such as a plate-type heat exchanger, may be used. The EGR cooler 300 includes an elongated, hollow, stainless steel housing 302 having a cylindrical outer side surface 304, a first end 306, and a second end 308 opposite the first end 306. In the exemplary embodiment, the housing 302 is made of stainless steel 316, but in other embodiments, other stainless steel alloys may be used to make the stainless steel housing 302.

The EGR cooler 300 includes a coolant inlet port 310 extending through the cylindrical outer side surface 304 to allow coolant to flow into the hollow interior of the housing 302 and a coolant outlet port 312 extending through the cylindrical outer side surface 304 to allow coolant to flow out of the hollow interior of the housing 302.

The first end 306 includes a first circular end plate 320 and the second end 308 includes a second circular end plate 322 substantially similar to the first circular end plate 320. The first and second end plates 320, 322 are made of stainless steel, such as for example, the same stainless steel alloy that is used for the housing 302. As shown in FIG. 3, the first end plate 320 has a first side face 323, a second side face 324 opposite and parallel to the first side face 323, and an end face 325 extending perpendicularly between the first side face 323 and the second side face 324. The first end plate 320 has a first thickness T1. In one exemplary embodiment, the first thickness T1 is in the range of 3 mm to 5 mm. In the exemplary embodiment, the second end plate 322 has a thickness (not shown) that is the same as the first thickness T1 of the first end plate 320.

Each of the first end plate 320 and the second end plate 322 have a plurality of holes 326 extending in the thickness direction. Each of the plurality of holes 326 in the first end plate 320 align with a corresponding one of the plurality of holes 326 in the second end plate 322 to form a pair of aligned holes 326. Each of the pair of aligned holes 326 have a stainless steel tube 328 associated therewith such that the EGR cooler includes a plurality of stainless steel tubes 328. In particular, each stainless steel tube 328 is mounted on one end into one of the holes 326 in the first end plate 320 and is mounted on the other end to the aligned one of holes 326 in the second end plate 322, such that each of the stainless steel tubes 328 extends through the elongated, hollow housing 302. The EGR cooler 300 may also include a plurality of flow baffles 329 within the hollow interior of the housing 302 to create a tortious path for the coolant flowing through the housing 302 from the coolant inlet port 310 to the coolant outlet port 312.

The EGR cooler 300 includes an Inconel diffuser 330 welded onto the first end plate 320 by the disclosed method. The EGR cooler 300 includes a collector 332 welded onto the second end plate 322. In the illustrated embodiment, the collector 332 is made of stainless steel, rather than Inconel, but otherwise is substantially the same as the Inconel diffuser 330. Thus, the description of the Inconel diffuser 330 applies equally to the collector 332. In other embodiments, however, the collector 332 may differ from the Inconel diffuser 330 or may be made from Inconel as well.

The Inconel diffuser 330 defines a gas inlet 336 to the EGR cooler 300 and the collector 332 defines a gas outlet 338 from the EGR cooler 300. The type of Inconel alloy and the type of stainless steel alloy used for the Inconel diffuser 330 and the stainless steel first end plate 320 may vary in different embodiments. In the illustrated embodiment, the Inconel first diffuser 330 is made from Inconel 625 alloy and the stainless steel first end plate 320, the stainless steel housing 302 of the EGR cooler 300, and the stainless steel collector 332 are made from stainless steel alloy 316.

In the illustrated embodiment, the Inconel diffuser 330 is made from Inconel 625 alloy. The Inconel diffuser 330 includes an inlet end 340 defining the gas inlet 336 and having an inlet diameter D1, and an outlet end 342, opposite the inlet end 340, defining a circular outlet having an outlet diameter D2. In the illustrated embodiment, the first end plate 320 has a diameter equal to the outlet diameter D2. In other embodiments, however, the diameter of the first end plate 320 may differ from the outlet diameter D2.

The Inconel diffuser 330 includes a thin-walled, outward flaring body 344 having a sidewall 345 with a wall thickness T2 adjacent the outlet end 342. In the illustrated embodiment, the outlet diameter D2 is greater than the inlet diameter D1. For example, the inlet diameter D1 may be in the range of 25% to 50% of the outlet diameter D2, such as for example 30% to 40% of the outlet diameter D2.

In the illustrated embodiment, the outlet end 342 of the Inconel diffuser 330 has an end face 349 that abuts, or is adjacent to, an outer peripheral surface 350 of the stainless steel first end plate 320 to form a weldable joint. The outer peripheral surface 350 may be the end face 325 or, as shown in the embodiment of FIG. 3, an outer portion of the first side face 323.

In the illustrated embodiment, the outlet end 342 of the Inconel diffuser 330 has an outer surface 354 that is coplanar, or nearly coplanar, with the end face 325 of the stainless steel first end plate 320. The Inconel diffuser 330 and the stainless steel first end plate 320 are welded in the position such that a weld bead 352 is formed over the interface between the outlet end 342 of the Inconel diffuser 330 and the outer peripheral surface 350 of the stainless steel first end plate 320. The weld bead 352 will extend around the entire circumference of the interface between the outlet end 342 of the Inconel first diffuser 330 and the stainless steel first end plate 320 to form a welded joint 360.

The welded joint 360 may be characterized as a butt joint. In will be understood, however, that in other embodiments, the Inconel diffuser 330 and the stainless steel first end plate 320 may be configured and arranged such that the welded joint is any suitable type of welded joint, such as for example, a corner joint, an edge joint, a lap joint, a tee joint, or other type of weld joint. Further, in the illustrated embodiment, the outlet end 342 of the Inconel diffuser 330 and the outer peripheral surface 350 of the stainless steel first end plate 320 are flat and parallel to each other at the weldable joint to form a single square groove. In other embodiments, however, one or more of the outlet end 342 of the Inconel diffuser 330 and the outer peripheral surface 350 of the stainless steel first end plate 320 may be configured other than flat and parallel to the other. For example, the weld joint may be a single bevel groove, double bevel groove, single-J groove, double-J groove, single-U groove, double-U groove, single-V groove, double-V groove, flanged groove, flare groove (such as a flare bevel or flare-V groove), or any suitable groove configuration.

The Inconel diffuser wall thickness T2 and the stainless steel first end plate thickness T1 may vary in different embodiments. In the illustrated embodiment, the Inconel diffuser wall thickness T2 is less than the stainless steel first end plate thickness T1. For example, in some embodiments, the Inconel diffuser wall thickness T2 is 50% or less than the stainless steel first end plate thickness T1, is 40% or less than the stainless steel first end plate thickness T1, is 35% or less than the stainless steel first end plate thickness T1, or is 30% or less than the stainless steel first end plate thickness T1. In one exemplary embodiment, the stainless steel first end plate thickness T1 is in the range of 3 mm to 5 mm. In another exemplary embodiment, the stainless steel first end plate thickness T1 is in the range of 3 mm to 5 mm and the Inconel diffuser wall thickness T2 is in the range of 30% to 40% of the stainless steel first end plate thickness T1, such as for example in the range of 1.0 mm to 1.5 mm.

During manufacturing of the EGR cooler 300, the outlet end 342 of Inconel diffuser 330 is welded to the stainless steel first end plate 320 of the housing 302 by a welding system. The welding system may be any suitable welding system that is capable of welding the disclosed Inconel diffuser 330 to the disclosed stainless steel first end plate 320. For example, a robot-based, gas metal arc welding (GMAW) system programmed with specific welding parameters may be used to join the Inconel diffuser 330 to the stainless steel first end plate 320. GMAW is an arc welding process in which a continuous solid weld wire electrode is fed through a welding torch/gun and into a weld pool formed between the components being welded, joining the two base materials together. It will be understood that the robot-based GMAW system may have a variety of configurations.

While suitable values for various welding parameters for welding stainless steel to stainless steel are well known and included in the software for many robotic welding systems, welding parameters for welding a thin-walled Inconel component to a thicker stainless steel component, such as the disclosed Inconel first diffuser 330 to the disclosed stainless steel first end plate 320, using a robotic GMAW system, are not conventionally known. In wire feed welding, the amount of wire protruding from a distal end of the welding torch is important, and the wire feed rate must be matched with the amperage and voltage being used and controlled to maintain proper protrusion of the weld wire from a distal end of the welding torch to generate a quality weld. Inconel has a greater resistivity to electrical current than stainless steel. Thus, for a given thickness of a component, the set-points used for key welding parameters for welding stainless steel to stainless steel, such as amperage, voltage, and wire feed rate, are not suitable for welding Inconel to stainless steel.

For example, in an attempt to gas metal arc weld, the Inconel diffuser 330 to the stainless steel end plate 320 using conventional amperage, voltage, and wire feed settings (135 amps, 22 volts, 0.6 m/min feed rate) for welding similar stainless steel components, the welding torch essentially functioned as a plasma cutter and cut through the plates.

One of skill in the art, when faced with the above scenario, would tend to lower the amperage in order to, essentially, reduce the heat being delivered by the torch to the weld joint. Counterintuitive to this approach, it was found that suitable output settings from a constant voltage welding power supply to weld the Inconel diffuser 330 to the stainless steel first end plate 320 included an amperage over 225 amps, a voltage below 20 volts, and a weld wire feed rate of about 0.6 m/min when using an Inconel 625 alloy weld wire having a diameter in the range of 0.030 inches (0.762 mm) to 0.045 inches (1.14 mm).

INDUSTRIAL APPLICABILITY

The novel EGR cooler 300 may be used in a variety of applications. For example, the EGR cooler 300 may be part of an engine system used to provide power to various types of applications and/or to machines, such as for example, an off-highway truck, a railway locomotive, a marine vessel, or an earth-moving machine. The term "machine" can also refer to stationary equipment like a generator that is driven by an internal combustion engine to generate electricity (i.e., gen-sets) or a pumping station having one or more pumps driven by an internal combustion engine.

EGR coolers operate in a corrosive environment. Conventional EGR coolers are primarily made of stainless steels due to the corrosion resistance of the material. EGR coolers can also be exposed to significant thermal loading and cycling since there is a high temperature difference between the exhaust gas being cooled and the coolant. The EGR cooler inlet diffuser and weld between the inlet diffuser and the EGR cooler end plate experience high cyclic thermal stress and pressure stress under various operating conditions, which can result in thermal fatigue failure, such as for example, cracking at the welds.

The novel EGR cooler 300 utilizes a thin-walled Inconel 625 stamped inlet diffuser welded to a stainless steel 316 end plate on the EGR cooler housing. The Inconel diffuser provides both oxidation/corrosion resistance as well as improved thermal performance by retaining its strength over a wide temperature range. Thus, the novel EGR cooler is less susceptible to thermal fatigue failure under high cyclic thermal stress and pressure stress operating conditions.

While the novel heat exchanger is described and illustrated as an EGR cooler, it may be used in other applications were cooling a fluid stream is desired. Unless otherwise indicated herein, all sub-embodiments and optional embodiments are respective sub-embodiments and optional embodiments to all embodiments described herein. While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details, the representative compositions or formulations, and illustrative examples shown and described. Accordingly, departures may be made from such details without departing from the spirit or scope of Applicant's general disclosure herein.

LIST OF ELEMENTS

| Element Number | Element Name |
|---|---|
| 100 | engine system |
| 102 | control valve |
| 104 | internal combustion engine |
| 105 | cylinders |
| 106 | intake ports |
| 108 | exhaust ports |
| 110 | intake manifold |
| 112 | intake line |
| 114 | exhaust manifold |
| 116 | exhaust line |
| 118 | exhaust aftertreatment devices |
| 120 | system |
| 122 | EGR conduit |
| 126 | EGR actuator |
| 128 | EGR cooler |
| 150 | controller |
| 300 | EGR cooler |
| 302 | housing |
| 304 | outer side surface |
| 306 | first end |
| 308 | second end |
| 310 | coolant inlet port |
| 312 | coolant outlet port |
| 320 | first end plate |
| 322 | second end plate |
| 323 | first side face |
| 324 | second side face |
| 325 | end face |
| 326 | holes |
| 328 | stainless steel tube |
| 329 | flow baffles |
| 330 | Inconel diffuser |
| 332 | collector |
| 336 | gas inlet |
| 338 | gas outlet |
| 340 | inlet end |
| 342 | outlet end |
| 344 | body |
| 345 | sidewall |
| 349 | end face |
| 350 | outer peripheral surface |
| 352 | weld bead |
| 354 | outer surface |
| 360 | welded joint |

What is claimed is:

1. An EGR cooler, comprising:

an elongated, stainless steel cooler housing including a first end and a second end opposite the first end, the first end including a stainless steel end plate having a first thickness; and a diffuser having an inlet end defining a gas inlet and an outlet end welded to the stainless steel end plate, the outlet end including a sidewall having a second thickness that is in the range of 30% to 40% of the first thickness, the diffuser being made from an austenitic nickel-chromium-based alloy including at least 58% nickel, at least 20% chromium, and at least 8% molybdenum.

2. The EGR cooler of claim 1, wherein the first thickness is in the range of 3 mm to 5 mm.

3. The EGR cooler of claim 2, wherein the second thickness is in the range of 1 mm to 1.5 mm.

4. The EGR cooler of claim 1, wherein the stainless steel end plate is made of stainless steel 316 alloy.

5. The EGR cooler of claim 1, wherein the inlet end has a first diameter and the outlet end has a second diameter that is greater than twice the first diameter.

6. The EGR cooler of claim 1, wherein the EGR cooler is a shell-and-tube heat exchanger.

7. An engine system, comprising:

an internal combustion engine, having an intake manifold for directing intake air into one or more engine cylinders and an exhaust manifold for routing exhaust from the one or more engine cylinders; and an exhaust system configured to receive exhaust from the exhaust manifold, the exhaust system including:

an EGR conduit arranged to direct a portion of the exhaust received from the exhaust manifold into the intake manifold; and an EGR cooler arranged in the EGR conduit for cooling the portion of the exhaust directed into the intake manifold, wherein the EGR cooler includes:

an elongated, stainless steel cooler housing including a first end and a second end opposite the first end, the first end including a stainless steel end plate having a first thickness; and a diffuser having an inlet end defining a gas inlet and an outlet end welded to the stainless steel end plate, the outlet end including a sidewall having a second thickness that is in the range of 30% to 40% of the first thickness, the diffuser being made from an austenitic nickel-chromium-based alloy including at least 58% nickel, at least 20% chromium, and at least 8% molybdenum.

8. The engine system of claim 7, wherein the first thickness is in the range of 3 mm to 5 mm.

9. The engine system of claim 8, wherein the second thickness is in the range of 1 mm to 1.5 mm.

10. The engine system of claim 7, wherein the stainless steel end plate is made of stainless steel 316 alloy.

11. The engine system of claim 7, wherein the inlet end has a first diameter and has outlet end has a second diameter that is greater than twice the first diameter.

12. The engine system of claim 7, wherein the EGR cooler is a shell-and-tube heat exchanger.

13. A method for cooling an exhaust stream being routing via an exhaust conduit from an exhaust manifold on an engine to an intake manifold on the engine, the method comprising:

directing coolant through a housing of a stainless steel heat exchanger;

directing the exhaust stream through a diffuser welded to a stainless steel end plate at a gas inlet end of the housing, the diffuser being made from an austenitic nickel-chromium-based alloy including at least 58% nickel, at least 20% chromium, and at least 8% molybdenum; and directing the exhaust stream through a plurality of tubes extending through the housing from the gas inlet to a gas outlet, wherein the stainless steel end plate has a first thickness, and the diffuser has a second thickness that is in the range of 30% to 40% of the first thickness.

14. The method of claim 13, wherein the stainless steel end plate includes stainless steel 316 alloy.

15. The method of claim 13, wherein the first thickness is in the range of range of 3 mm to 5 mm.

* * * * *